US006416164B1

(12) United States Patent
Stearns et al.

(10) Patent No.: US 6,416,164 B1
(45) Date of Patent: Jul. 9, 2002

(54) ACOUSTIC EJECTION OF FLUIDS USING LARGE F-NUMBER FOCUSING ELEMENTS

(75) Inventors: Richard G. Stearns, Felton; Richard N. Ellson, Palo Alto, both of CA (US)

(73) Assignee: Picoliter Inc., Mountain View, CA (US)

( * ) Notice: Subject to any disclaimer, the term of this patent is extended or adjusted under 35 U.S.C. 154(b) by 0 days.

(21) Appl. No.: 09/910,690

(22) Filed: Jul. 20, 2001

(51) Int. Cl.[7] ..... B41J 2/04
(52) U.S. Cl. ..... 347/46
(58) Field of Search ..... 347/46

(56) References Cited

U.S. PATENT DOCUMENTS

| | | | | |
|---|---|---|---|---|
| 4,308,547 A | | 12/1981 | Lovelady et al. | 347/46 |
| 4,697,195 A | | 9/1987 | Quate et al. | 347/46 |
| 4,751,529 A | | 6/1988 | Elrod et al. | 347/46 |
| 5,041,849 A | | 8/1991 | Quate et al. | 347/46 |
| 6,364,454 B1 | * | 4/2002 | Hadimioglu | 347/46 |

FOREIGN PATENT DOCUMENTS

| | | | | |
|---|---|---|---|---|
| EP | 0493102 A1 | * | 1/1992 | 347/46 |

OTHER PUBLICATIONS

Elrod et al. (1989), "Nozzleless Droplet Formation with Focused Acoustic Beams," *J. Appl. Phys.* 65(9):3441–3447.

* cited by examiner

*Primary Examiner*—John Barlow
*Assistant Examiner*—Julian D. Huffman
(74) *Attorney, Agent, or Firm*—Reed & Associates; Dianne E. Reed; J. Elin Hartrum

(57) ABSTRACT

The present invention provides a method and device for the acoustic ejection of fluid droplets from fluid-containing reservoirs using focusing means having an F-number greater than approximately 2. The droplets are ejected toward designated sites on a substrate surface for deposition thereon. In one embodiment, the device is comprised of: a plurality of reservoirs each adapted to contain a fluid; an ejector comprising a means for generating acoustic radiation and a large F-numbered means for focusing the acoustic radiation at a focal point near the fluid surface in each of the reservoirs; and a means for positioning the ejector in acoustically coupled relationship to each of the reservoirs. The invention is useful in a number of contexts, particularly in the preparation of biomolecular arrays.

59 Claims, 11 Drawing Sheets

ACOUSTIC EJECTION OF FLUIDS USING LARGE F-NUMBER FOCUSING ELEMENTS

TECHNICAL FIELD

This invention relates generally to the use of focused acoustic energy in the ejection of fluids, and more particularly relates to acoustic ejection of fluid droplets using a large F-number focusing element.

BACKGROUND

A number of patents have described the use of acoustic energy in droplet ejection. For example, U.S. Pat. No. 4,308,547 to Lovelady et al. describes a liquid drop emitter that utilizes acoustic principles in ejecting liquid from a body of liquid onto a moving document for forming characters or bar codes thereon. Lovelady et al. is directed to a nozzleless inkjet printing apparatus wherein controlled drops of ink are propelled by an acoustical force produced by a curved transducer at or below the surface of the ink.

The Lovelady et al. patent makes use of a piezoelectric shell transducer to both generate and focus the acoustic energy. Several other methods have also been developed to focus the generated acoustic energy and eject a droplet of liquid. For example, acoustically illuminated spherical acoustic focusing lenses as described in U.S. Pat. No. 4,751,529 to Elrod et al. and planar piezoelectric transducers with interdigitated electrodes as described in U.S. Pat. No. 4,697,105 to Quate et al. The existing droplet ejector technology has been used in designing various printhead configurations, ranging from relatively simple, single ejector embodiments for raster output scanners (ROS's) to more complex embodiments, such as one or two dimensional, full page width arrays of droplet ejectors for line printing. It has also found use in the synthesis of arrays of biological materials, as described in co-pending, commonly assigned applications Ser. No. 09/669,996, "ACOUSTIC EJECTION OF FLUIDS FROM A PLURALITY OF RESERVOIRS," filed Sep. 25, 2000, Ser. No. 09/727,392, "FOCUSED ACOUSTIC ENERGY IN THE PREPARATION AND SCREENING OF COMBINATORIAL LIBRARIES," filed Nov. 29, 2000, and Ser. No. 09/765,947, "HIGH THROUGHPUT BIOMOLECULAR CRYSTALLIZATION AND BIOMOLECULAR CRYSTAL SCREENING," filed Jan. 19, 2001.

However, the development of nozzleless fluid ejection has generally been limited to ink printing applications and has relied exclusively upon acoustic lenses having F-numbers of approximately 1. Unfortunately, low F-number lenses place restrictions on the reservoir and fluid level geometry and provide relatively limited depth of focus, increasing the sensitivity to the fluid level in the reservoir. For example, in bimolecular array applications the various bimolecular materials from which the array is constructed are usually contained in individual wells in a well plate. These wells often have aspect ratios of approximately 5:1, i.e., the wells are five times as deep as their diameter. The narrowness of the wells requires that when F1 lenses are used the surface of the fluid within the reservoir be no further from the lens than the width of the lens aperture. Therefore, when using an F1 lens in a 5:1 aspect ratio well, only the bottom fifth of the reservoir may be filled with fluid.

Thus, there is a need in the art for improved acoustic fluid ejection devices and methods having sufficient droplet ejection accuracy so as to enable preparation of high-density molecular arrays without the disadvantages associated with low F-numbered lenses. While the use of F2 lenses has been suggested in Elrod et al. (1989), "Nozzleless droplet formation with focused acoustic beams," *J. Appl. Phys* 65(9):3441–3447, the reference indicates that such lenses provide unpredictable results in terms of droplet diameter and usable depth of focus. Surprisingly, it has now been found that larger F-numbered lenses provide additional advantages over F1 lenses as the use of lenses having F-numbers greater than 2 allows for far greater control over droplet size and velocity while providing greatly enhanced depth of focus.

SUMMARY OF THE INVENTION

Accordingly, it is an object of the present invention to provide devices and methods that overcome the above-mentioned disadvantages of the prior art. In one aspect of the invention, a device is provided for acoustically ejecting a plurality of fluid droplets toward a designated site on a substrate surface, comprising: a reservoir adapted to contain a fluid having an aperture that enables conduction of acoustic energy in a substantially uniform manner, said aperture having an effective dimension; and an ejector comprised of an acoustic radiation generator for generating acoustic radiation and a focusing means capable of focusing the generated acoustic radiation to emit a droplet from a surface of a fluid contained within the fluid reservoir said surface being an effective distance from the aperture, wherein the ratio of the effective distance to the aperture to the effective dimension of the aperture is greater than about 2:1. The device may further comprise a means for positioning the ejector in acoustic coupling relationship to the reservoir. Preferably, the ratio is greater than approximately 3:1, or even greater than about 4:1. The device may also comprise a plurality of reservoirs each adapted to contain a fluid, and wherein the device is capable of ejecting a fluid droplet from each of the plurality of reservoirs toward a plurality of designated sites on the substrate surface.

In another aspect, the invention relates to a method for ejecting fluids from fluid reservoirs toward designated sites on a substrate surface. The method involves providing a device comprised of a reservoir containing a first fluid, said reservoir having an aperture that enables conduction of acoustic energy in a substantially uniform manner, said aperture having an effective dimension and an ejector comprised of an acoustic radiation generator for generating acoustic radiation and a focusing means capable of focusing the generated acoustic radiation to emit a droplet from a surface of the first fluid contained within the fluid reservoir said surface being an effective distance from the aperture, wherein the ratio of the effective distance from the aperture to the effective dimension of the aperture is greater than about 2:1. The ejector is then positioned so as to be in acoustically coupled relationship to the fluid-containing reservoir, so that the position of the ejector places the focal point of the ejecting means near the surface of the first fluid, and hence, the effective distance from the aperture. Finally, the ejector is activated, thereby generating acoustic radiation having a focal spot of a diameter D at the surface of the first fluid, resulting in the ejection a droplet of the first fluid from the reservoir. If desired, the method may be repeated with a plurality of fluid reservoirs each containing a fluid, with each reservoir generally although not necessarily containing a different fluid. The acoustic ejector is thus repeatedly repositioned so as to eject a droplet from each reservoir toward a different designated site on a substrate surface. In such a way, the method is readily adapted for use in generating an array of molecular moieties on a substrate surface.

BRIEF DESCRIPTION OF THE DRAWINGS

FIG. 2A shows the acoustic ejector acoustically coupled to the first reservoir and having been activated in order to eject a droplet of fluid from within the first reservoir toward a designated site on a substrate surface. FIG. 2B shows the acoustic ejector acoustically coupled to a second reservoir.

FIG. 3A is a schematic top plan view of the two well plates, i.e., the reservoir well plate and the substrate well plate. FIG. 3B illustrates in cross-sectional view a device comprising the reservoir well plate of FIG. 3A acoustically coupled to an acoustic ejector, wherein a droplet is ejected from a first well of the reservoir well plate into a first well of the substrate well plate. FIG. 3C illustrates in cross-sectional view the device illustrated in FIG. 3B, wherein the acoustic ejector is acoustically coupled to a second well of the reservoir well plate and further wherein the device is aligned to enable the acoustic ejector to eject a droplet from the second well of the reservoir well plate to a second well of the substrate well plate.

DETAILED DESCRIPTION OF THE INVENTION

Definitions and Overview

Figure 1A:
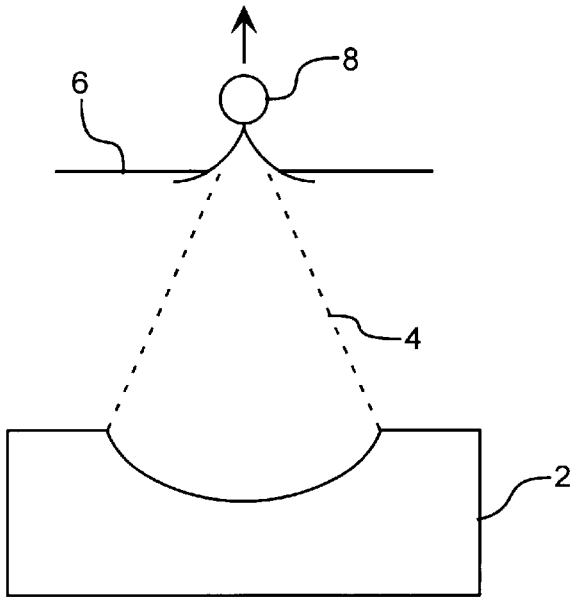
FIGS. 1A and 1B schematically illustrate droplet ejection from a low F-number, i.e., having an F-number of approximately less than 1, and a high F-number lens, i.e., having an F-number of approximately higher than 2, respectively.

Before describing the present invention in detail, it is to be understood that this invention is not limited to specific fluids, biomolecules or device structures, as such may vary. It is also to be understood that the terminology used herein is for the purpose of describing particular embodiments only, and is not intended to be limiting.

It must be noted that, as used in this specification and the appended claims, the singular forms "a," "an" and "the" include plural referents unless the context clearly dictates otherwise. Thus, for example, reference to "a reservoir" includes a plurality of reservoirs, reference to "a fluid" includes a plurality of fluids, reference to "a biomolecule" includes a combination of biomolecules, and the like.

In describing and claiming the present invention, the following terminology will be used in accordance with the definitions set out below.

The terms "acoustic coupling" and "acoustically coupled" used herein refer to a state wherein an object is placed in direct or indirect contact with another object so as to allow acoustic radiation to be transferred between the objects without substantial loss of acoustic energy. When two items are indirectly acoustically coupled, an "acoustic coupling medium" is needed to provide an intermediary through which acoustic radiation may be transmitted. Thus, an ejector may be acoustically coupled to a fluid, e.g., by immersing the ejector in the fluid or by interposing an acoustic coupling medium between the ejector and the fluid to transfer acoustic radiation generated by the ejector through the acoustic coupling medium and into the fluid.

The term "adsorb" as used herein refers to the noncovalent retention of a molecule by a substrate surface. That is, adsorption occurs as a result of noncovalent interaction between a substrate surface and adsorbing moieties present on the molecule that is adsorbed. Adsorption may occur through hydrogen bonding, van der Waal's forces, polar attraction or electrostatic forces (i.e., through ionic bonding). Examples of adsorbing moieties include, but are not limited to, amine groups, carboxylic acid moieties, hydroxyl groups, nitroso groups, sulfones and the like.

The term "array" used herein refers to a two-dimensional arrangement of features such as an arrangement of reservoirs (e.g., wells in a well plate) or an arrangement of fluid droplets or molecular moieties on a substrate surface (as in an oligonucleotide or peptidic array). Arrays are generally comprised of regular, ordered features, as in, for example, a rectilinear grid, parallel stripes, spirals, and the like, but non-ordered arrays may be advantageously used as well. An array differs from a pattern in that patterns do not necessarily contain regular and ordered features. Neither arrays nor patterns formed using the devices and methods of the invention have optical significance to the unaided human eye. For example, the invention does not involve ink printing on paper or other substrates in order to form letters, numbers, bar codes, figures, or other inscriptions that have optical significance to the unaided human eye. In addition, arrays and patterns formed by the deposition of ejected droplets on a surface as provided herein are preferably substantially invisible to the unaided human eye. Arrays typically but do not necessarily comprise at least about 4 to about 10,000,000 features, generally in the range of about 4 to about 1,000,000 features.

The term "attached," as in, for example, a substrate surface having a molecular moiety "attached" thereto (e.g., in the individual molecular moieties in arrays generated using the methodology of the invention) includes covalent binding, adsorption, and physical immobilization. The terms "binding" and "bound" are identical in meaning to the term "attached."

The term "biomolecule" as used herein refers to any organic molecule, whether naturally occurring, recombinantly produced, or chemically synthesized in whole or in part, that is, was or can be a part of a living organism. The term encompasses, for example, nucleotides, amino acids and monosaccharides, as well as oligomeric and polymeric species such as oligonucleotides and polynucleotides, peptidic molecules such as oligopeptides, polypeptides and proteins, and saccharides such as disaccharides, oligosaccharides, polysaccharides, and the like.

It will be appreciated that, as used herein, the terms "nucleoside" and "nucleotide" refer to nucleosides and nucleotides containing not only the conventional purine and pyrimidine bases, i.e., adenine (A), thymine (T), cytosine (C), guanine (G) and uracil (U), but also protected forms thereof, e.g., wherein the base is protected with a protecting group such as acetyl, difluoroacetyl, trifluoroacetyl, isobutyryl or benzoyl, and purine and pyrimidine analogs. Suitable analogs will be known to those skilled in the art and are described in the pertinent texts and literature. Common analogs include, but are not limited to, 1-methyladenine, 2-methyladenine, $N^6$-methyladenine, $N^6$-isopentyl-adenine, 2-methylthio-$N^6$-isopentyladenine, N,N-dimethyladenine, 8-bromoadenine, 2-thiocytosine, 3-methylcytosine, 5-methylcytosine, 5-ethylcytosine, 4-acetylcytosine, 1-methylguanine, 2-methylguanine, 7-methylguanine, 2,2-dimethylguanine, 8-bromo-guanine, 8-chloroguanine, 8-aminoguanine, 8-methylguanine, 8-thioguanine, 5-fluorouracil, 5-bromouracil, 5-chlorouracil, 5-iodouracil, 5-ethyluracil, 5-propyluracil, 5-methoxyuracil, 5-hydroxymethyluracil, 5-(carboxyhydroxymethyl)uracil, 5-(methylaminomethyl)uracil, 5-(carboxymethylaminomethyl)-uracil, 2-thiouracil, 5-methyl-2-thiouracil, 5-(2-bromovinyl)uracil, uracil-5-oxyacetic acid, uracil-5-oxyacetic acid methyl ester, pseudouracil, 1-methylpseudouracil, queosine, inosine, 1-methylinosine, hypoxanthine, xanthine, 2-aminopurine, 6-hydroxy-aminopurine, 6-thiopurine and 2,6-diaminopurine. In addition, the terms "nucleoside" and "nucleotide" include those moieties that contain not only conventional ribose and deoxyribose sugars, but other sugars as well. Modified nucleosides or nucleotides also include modifications on the sugar moiety, e.g., wherein one or more of the hydroxyl groups are replaced with halogen atoms or aliphatic groups, or are functionalized as ethers, amines, or the like.

As used herein, the term "oligonucleotide" shall be generic to polydeoxynucleotides (containing 2-deoxy-D-ribose), to polyribonucleotides (containing D-ribose), to any other type of polynucleotide which is an N-glycoside of a purine or pyrimidine base, and to other polymers containing nonnucleotidic backbones, providing that the polymers contain nucleobases in a configuration that allows for base pairing and base stacking, such as is found in DNA and RNA. Thus, these terms include known types of oligonucleotide modifications, for example, substitution of one or more of the naturally occurring nucleotides with an analog, internucleotide modifications such as, for example, those with uncharged linkages (e.g., methyl phosphonates, phosphotriesters, phosphoramidates, carbamates, etc.), with negatively charged linkages (e.g., phosphorothioates, phosphorodithioates, etc.), and with positively charged linkages (e.g., aminoalklyphosphoramidates, aminoalkylphosphotriesters), those containing pendant moieties, such as, for example, proteins (including nucleases, toxins, antibodies, signal peptides, poly-L-lysine, etc.), those with intercalators (e.g., acridine, psoralen, etc.), those containing chelators (e.g., metals, radioactive metals, boron, oxidative metals, etc.). There is no intended distinction in length between the terms "polynucleotide" and "oligonucleotide," and these terms will be used interchangeably. These terms refer only to the primary structure of the molecule. As used herein the symbols for nucleotides and polynucleotides are according to the IUPACIUB Commission of Biochemical Nomenclature recommendations (*Biochemistry* 9:4022, 1970).

"Peptidic" molecules refer to peptides, peptide fragments, and proteins, i.e., oligomers or polymers wherein the constituent monomers are alpha amino acids linked through amide bonds. The amino acids of the peptidic molecules herein include the twenty conventional amino acids, stereoisomers (e.g., D-amino acids) of the conventional amino acids, unnatural amino acids such as, -disubstituted amino acids, N-alkyl amino acids, lactic acid, and other unconventional amino acids. Examples of unconventional amino acids include, but are not limited to, -alanine, naphthylalanine, 3-pyridylalanine, 4-hydroxyproline, O-phosphoserine, N-acetylserine, N-formylmethionine, 3-methylhistidine, 5-hydroxylysine, and nor-leucine.

The term "fluid" as used herein refers to matter that is nonsolid or at least partially gaseous and/or liquid. A fluid may contain a solid that is minimally, partially or fully solvated, dispersed or suspended. Examples of fluids include, without limitation, aqueous liquids (including water per se and salt water) and nonaqueous liquids such as organic solvents and the like. As used herein, the term "fluid" is not synonymous with the term "ink" in that an ink must contain a colorant and may not be gaseous and/or liquid.

The term "reservoir" as used herein refers a receptacle or chamber for holding or containing a fluid. Thus, a fluid in a reservoir necessarily has a free surface, i.e., a surface that allows a droplet to be ejected therefrom.

The term "substrate" as used herein refers to any material having a surface onto which one or more fluids may be deposited. The substrate may be constructed in any of a number of forms such as wafers, slides, well plates, membranes, for example. In addition, the substrate may be porous or nonporous as may be required for any particular fluid deposition. Suitable substrate materials include, but are not limited to, supports that are typically used for solid phase chemical synthesis, e.g., polymeric materials (e.g., polystyrene, polyvinyl acetate, polyvinyl chloride, polyvinyl pyrrolidone, polyacrylonitrile, polyacrylamide, polymethyl methacrylate, polytetrafluoroethylene, polyethylene, polypropylene, polyvinylidene fluoride, polycarbonate, divinylbenzene styrene-based polymers), agarose (e.g., Sepharose®), dextran (e.g., Sephadex®), cellulosic polymers and other polysaccharides, silica and silica-based materials, glass (particularly controlled pore glass, or "CPG") and functionalized glasses, ceramics, and such substrates treated with surface coatings, e.g., with microporous polymers (particularly cellulosic polymers such as nitrocellulose), metallic compounds (particularly microporous aluminum), or the like. While the foregoing support materials are representative of conventionally used substrates, it is to be understood that the substrate may in fact comprise any biological, nonbiological, organic and/or inorganic material, and may be in any of a variety of physical forms, e.g., particles, strands, precipitates, gels, sheets, tubing, spheres, containers, capillaries, pads, slices, films, plates, slides, and the like, and may further have any desired shape, such as a disc, square, sphere, circle, etc. The substrate surface may or may not be flat, e.g., the surface may contain raised or depressed regions.

The term "surface modification" as used herein refers to the chemical and/or physical alteration of a surface by an additive or subtractive process to change one or more chemical and/or physical properties of a substrate surface or a selected site or region of a substrate surface. For example, surface modification may involve (1) changing the wetting properties of a surface, (2) functionalizing a surface, i.e., providing, modifying or substituting surface functional groups, (3) defunctionalizing a surface, i.e., removing surface functional groups, (4) otherwise altering the chemical composition of a surface, e.g., through etching, (5) increasing or decreasing surface roughness, (6) providing a coating on a surface, e.g., a coating that exhibits wetting properties that are different from the wetting properties of the surface, and/or (7) depositing particulates on a surface.

In one embodiment, then, the invention pertains to a device for acoustically ejecting a droplet toward a designated site on a substrate surface. The device comprises one or more reservoirs, each adapted to contain a fluid and each having an aperture having an effective dimension that enables conduction of acoustic energy in a substantially uniform manner; an ejector comprised of an acoustic radiation generator for generating acoustic radiation and a focusing means capable of focusing the generated acoustic radiation to emit a droplet from a surface of a fluid contained within the fluid reservoir said surface being an effective distance from the aperture, wherein the ratio of the effective distance from the aperture to the effective dimension of the aperture is greater than about 2:1.; and, optionally, a means for positioning the ejector in acoustic coupling relationship to each of the reservoirs, should there be more than one reservoir present.

Ejection of droplets from the free surface of a fluid is known to occur when acoustic energy of sufficient intensity is focused through the fluid medium onto the surface of the fluid. The ratio of the distance from the focusing means to the focal point of the focusing means with respect to the size of the aperture though which the acoustic energy passes into the fluid medium is the F-number. Lenses having an F-number less than one generate tightly focused acoustic beams and the focal distance of such a lens is shorter than the width of the lens aperture. Drop ejection behavior from lenses with F-numbers very close to 1 is well known in the art. In particular, the relationships between the focused beam size and resulting drop size are well understood, as well as the relationships that govern the sensitivity of the ejection to fluid height (i.e. to the relative placement of the fluid surface with respect to the focal plane of the acoustic beam). Also relatively well understood are factors governing the onset of unwanted secondary droplet ejection (known as satellite drops).

These relationships in many instances limit the performance of the drop ejection, or limit the flexibility to construct a physical system to eject drops of different size, etc., or place strong constraints on the tolerance of an ejection system to the variation of certain critical parameters, such as the location of the fluid surface with respect to the focal plane of the acoustic beam. In addition, using a tightly focusing acoustic wave naturally limits the ability to eject drops from the top of a fluid layer of height h, when the acoustic beam must past through an aperture of width substantially less than h, at the bottom of the fluid layer. Such a configuration is of interest for many applications, particularly when the reservoirs for containing the fluid to be ejected take the form of conventionally used and commercially available well plates. Typical 1536 well plates from Greiner have height to aperture ratios of 3.3 (5H/1.53 Amm). Plates from Greiner and NUNC in 384 format range from 3 to 4 (5.5H/1.84 Amm and 11.6H/2.9 Amm).

Use of a weakly focusing lens, i.e., a lens having an F-number greater than approximately 2, extends the ability of the ejector to eject drops through a fluid layer via the aperture at the bottom of the reservoir containing the fluid. Surprisingly, it has also been found that ejection process using a larger F-number lens is significantly different than the processes observed using lower F-number lenses. These differences, which are quite novel and unexpected, extend the flexibility and utility of the use of focused acoustic waves in droplet ejection and manipulation from a fluid surface. Lower F# lenses, i.e., F1, can be used so long as the aperture of the reservoir has a diameter that is sufficient to result in the ratio of the effective distance from the aperture to the cross-sectional width of the aperture is greater than about 2:1. The use of such lens is undesirable as such lenses result in variation of the amount of acoustic energy as a function of fluid depth, thereby increasing the sensitivity of apparent ejection threshold energy to fluid height. Such methods are also not preferred as, in applications wherein the reservoir is a well in a well plate, acoustic energy that is absorbed into the well wall by virtue of the narrow aperture may, after significant refraction, undesirably and unpredictable pass into the reservoir and interfere with droplet ejection.

Schematically, a typical acoustic lens and focused beam look as shown in FIG. 1. FIG. 1A illustrates the general profile of the fluid surface at the time of drop separation, for excitation using a low F-number acoustic lens 2. In FIG. 1A, the focused acoustic beam 4 is focused at the surface of the fluid 6. As discussed by Elrod et al. (1989) *J. Appl. Phys.* 65(9):3441–3447, the focused beam size for an acoustic burst of 3 dB is of order $1.02*F*\lambda$, where $\lambda$ is the acoustic wavelength. Thus, for a lens of F-number 1 (F1 ), a 3 dB acoustic burst has a focused beam size nearly equal to the acoustic wavelength. It is well known that for the F1 lens, the resulting drop 8 is approximately equal in size to the focused beam. This result makes physical sense, as the focused beam can be thought of as generating a column, or jet, of fluid that rises from the free surface due to the radiation pressure of the acoustic wave acting on the surface. Since the column of fluid is roughly the size of the focused beam in lateral extent, the well-known Rayleigh instability of fluid jets leads to the expectation that such a column would produce a droplet of a size comparable to that of the jet, and hence to that of the focused acoustic beam.

Figure 1B:
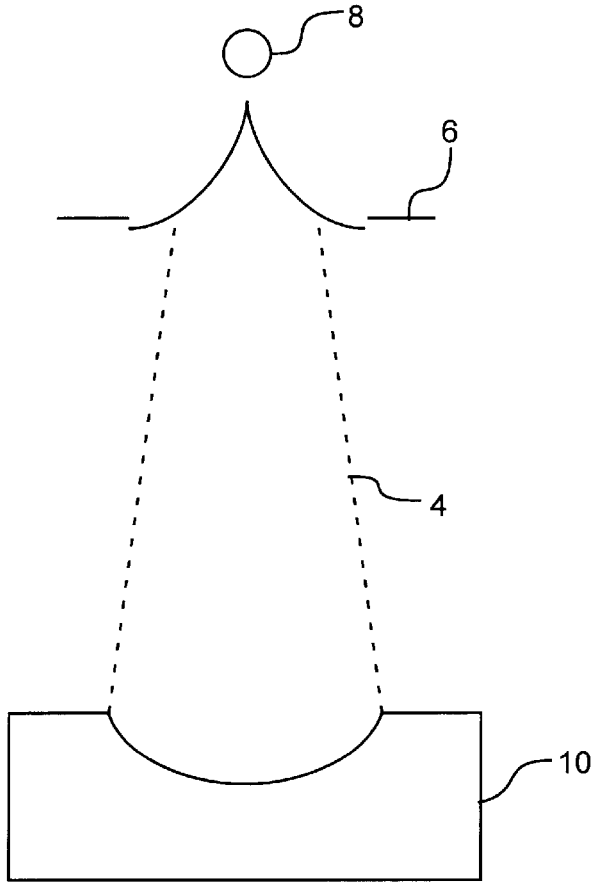

As indicated in FIG. 1B, the results when using a higher F-number lens 10 differ substantially from what might be expected were one to extend the general understanding of F1 droplet ejection discussed above. In this case, the larger aperture does produce a focused acoustic beam having a larger lateral dimension. However, the primary drop that is ejected is considerably less in size than the focused beam that produces it. As one example, when using F3 lens at an acoustic frequency of 30 MHz, a primary droplet would be expected to have a diameter comparable with the lateral dimension of the focused acoustic beam. At 30 MHz, the acoustic wavelength of water is 50 $\mu$m, resulting in a focused acoustic beam having a diameter of 153 $\mu$m. Unexpectedly, the actual diameter of a droplet produced under these conditions is 54 $\mu$m, relatively corresponding to the acoustic frequency and not to the diameter of the focused acoustic beam. Similar results have been obtained for F4 lenses as well.

The fact that such relatively small drops may be produced with a higher F-number lens has great practical value, as now, for the same aperture size, one may eject from a fluid layer of greater height (as indicated in FIG. 1B). Using a weakly focusing lens allows one to project the focal point farther into a column of fluid where either the aperture or the plane of entry for the acoustic energy is limited in size. For example, consider the base of a Greiner 1536 well whose extent is 1.53 mm. The narrowness of the well limits the physical dimension of the acoustic beam entering the column of liquid contained with in the well as acoustic beams that are wider than the base of the well results in the unwanted generation of a complex pattern of refraction in the well walls. The height of the walls in such well is 5 mm, more than 3 times the dimension of the base. Using a F1 lens and keeping the extent of the acoustic energy within the well base, the greatest depth from which the lens could effect ejection would be substantially under 2 mm. Hence, fluid could not be ejected from the well if the well was more than half full. In contrast, by using a weakly focusing lens such as an F3 lens, the full height of the liquid would be within the range of focus.

Additionally, the ability to eject drops comparable to the acoustic wavelength using a higher F-number lens allows for greater latitude in fixing the location of the fluid surface, relative to the focal plane of the acoustic beam. This is because the depth of focus of the beam varies as the square of the F-number. Thus, by using the larger F-number lens, the beam is substantially near focus for a longer distance along its direction of propagation and there is a larger range along the axis of propagation at which the fluid surface is relative to the focal plane of the acoustic beam resulting in droplet formation. Using an F3 lens at 30 MHz, it has been observed that a primary drop will be ejected over a range of 1 mm of fluid depth, within a 1 dB window of incident acoustic power. This is a substantially larger range than would be expected using an F1 lens to produce a comparable drop. Such improvement in latitude of the fluid height, while maintaining droplet size, is of great practical significance as many fluid dispensing applications benefit from having highly repeatable drop volume.

While not wishing to be limited by theory, the unexpected result that droplets having a diameter much smaller than the focused acoustic beam size may be produced using a larger F-number lens is presumably due to subtle details of the Rayleigh instability that is responsible for their formation. There may also be some role played by nonlinear harmonic generation in the focal region of the acoustic beam. The novel behavior of the droplet formation process using higher F-number lenses results in other useful features as well. One of these is the ability to tune the volume of ejected fluid per tone burst, droplet size, and/or droplet velocity for a given acoustic transducer and lens, by varying the acoustic frequency, toneburst duration, and/or the applied acoustic power. Variation of these parameters, either separately, or in combination, allows for precisely controlled fluid ejection. A brief discussion of each of these parameters is presented below.

Variation of Acoustic Power

In traditional F1 lens applications, alteration of the acoustic power has served as a means to vary the ejection velocity. Excessively high power level result in the ejection of secondary or "satellite" droplets. Unexpectedly, the secondary or satellite drops that are formed using higher F-number lenses have properties that differ from those formed using a lower F-number lens. For example, the secondary drop formed using an F1 lens with water is typically much smaller than the primary drop. In the case of an F3 lens, the secondary drop may be much larger than the primary drop. Furthermore, the size of the satellite droplet changes dramatically with the duration of the RF toneburst excitation and/or the acoustic frequency and under some condition, the secondary droplet may be much smaller than the primary droplet. This unusual behavior can be exploited to greatly control the range of volume ejected during a single acoustic ejection event. For example, if both the primary and secondary drops are ejected and deposited together, the total volume of both drops has been observed to vary over a range of approximately 40 pL to approximately 700 pL, i.e., over 1750%.

Figure 7:
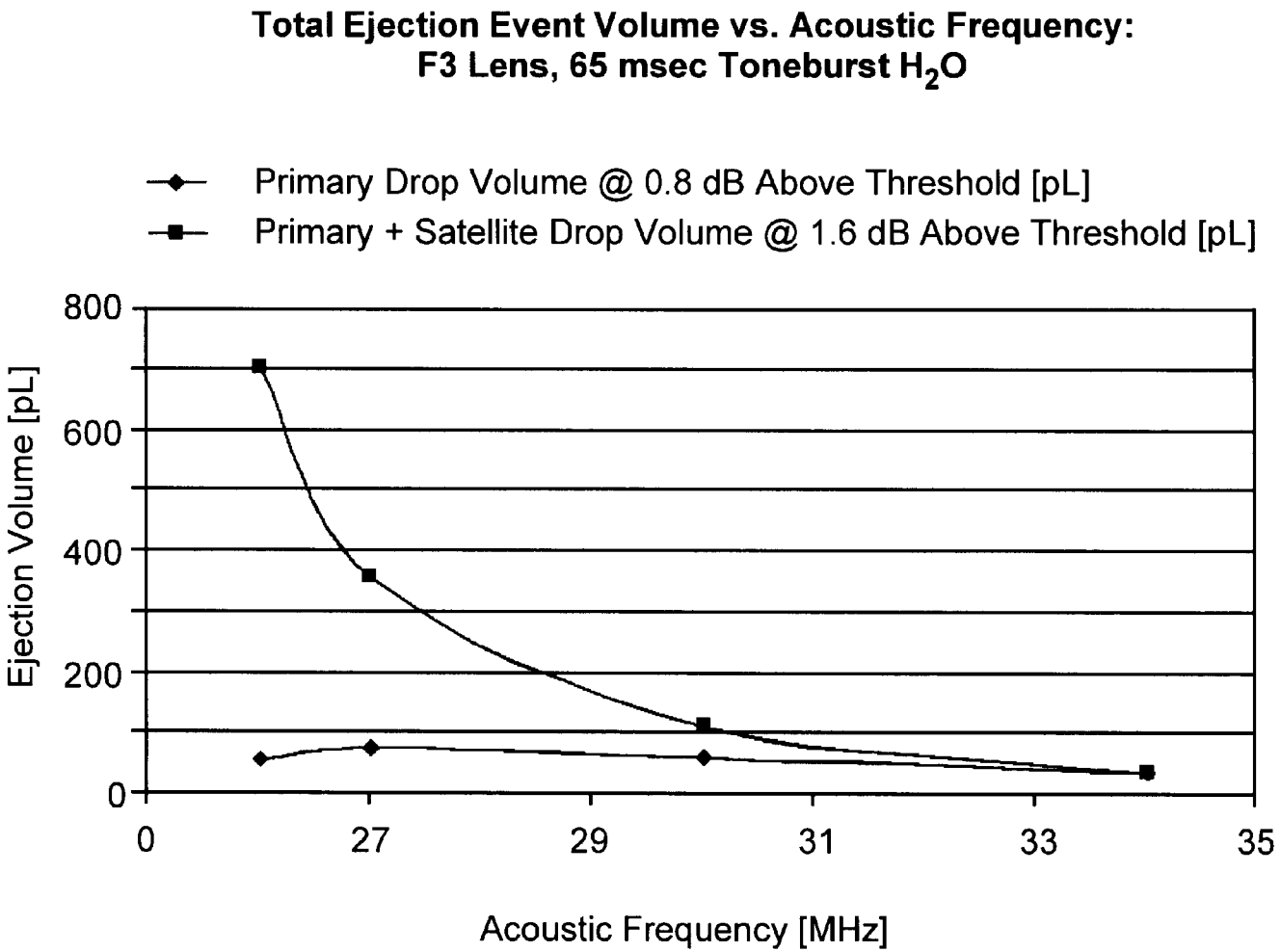
FIG. 7 graphically illustrates changes in total ejection volume with respect to acoustic frequency for an F3 lens using acoustic power 0.8 and 1.6 dB above the ejection threshold and having a toneburst duration of 65 $\mu$sec.
Figure 8:
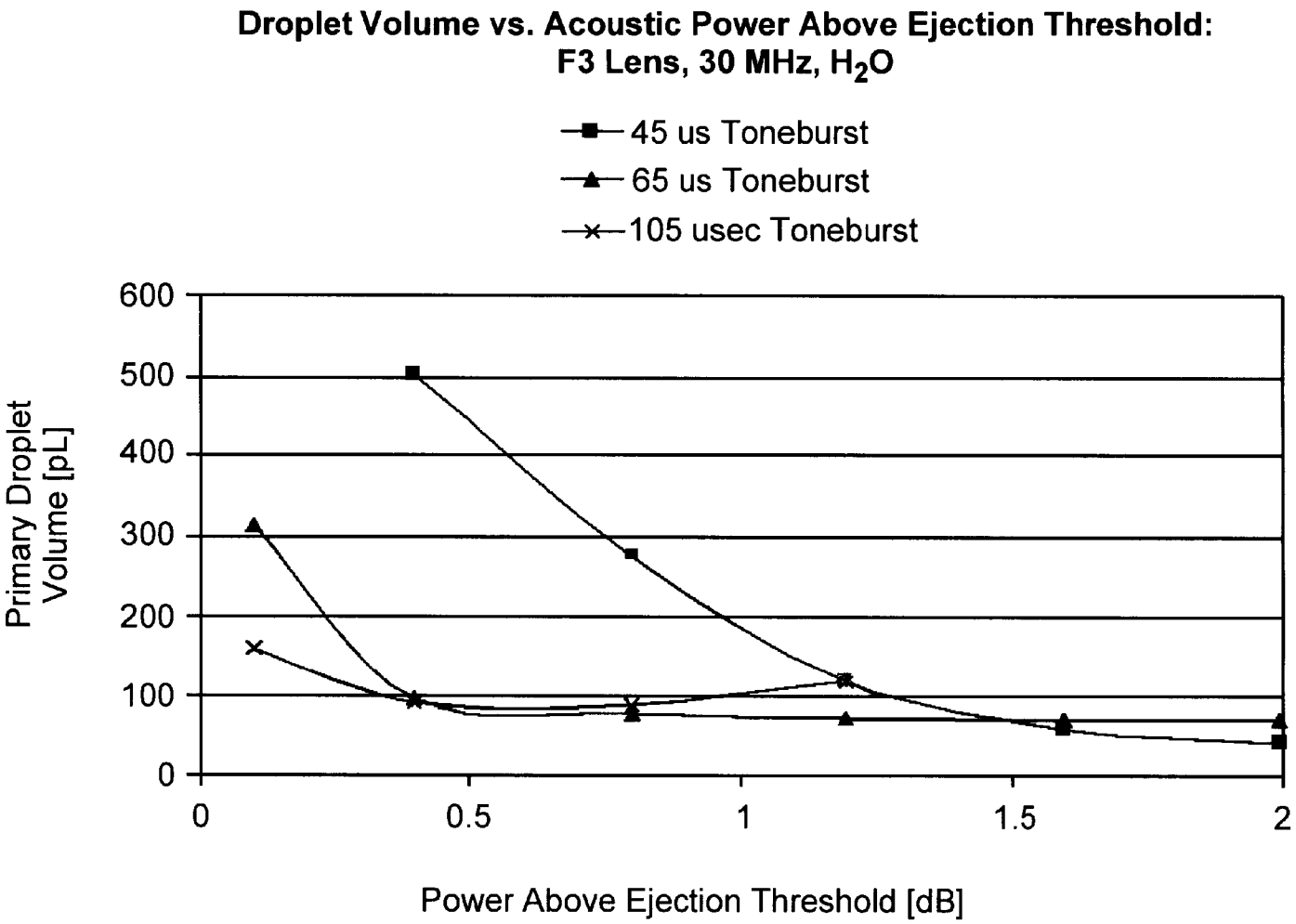
FIG. 8 graphically illustrates changes in droplet volume with respect to acoustic power above the ejection threshold for an F3 lens using a 45, 65, and 105 $\mu$sec tonebursts at an acoustic frequency of 30 MHz.
Figure 9:
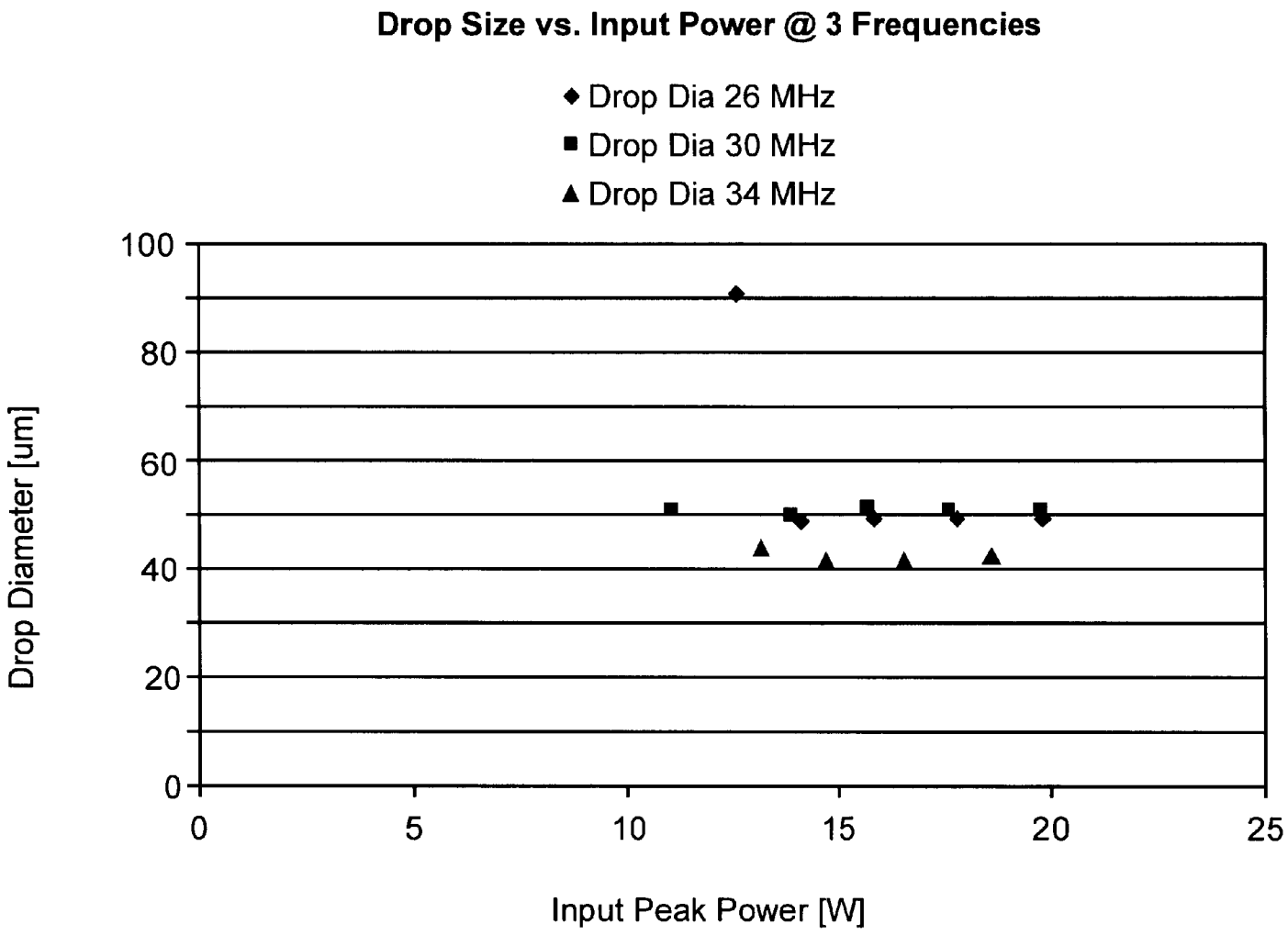
FIG. 9 graphically illustrates changes in droplet diameter with respect to acoustic frequency at various input power levels using a 26, 30, and 34 MHz acoustic frequencies.

It has been observed that for a 25 MHz F3 lens, over a range of fluid heights, secondary (satellite) drop ejection does not occur until the input acoustic power is many dB above the energy threshold for ejection of the primary drop. Specifically, it has been found that application of acoustic power 0.8 dB above the ejection threshold corresponds to an acoustic power where only the primary drop is ejected, and 1.6 dB above threshold corresponds to a power where the primary and satellite drops are ejected. These parameters will vary for the specific conditions utilized. The large stable range wherein only a single droplet is ejected is of great practical benefit as, in general, it is desired that only the primary drop be ejected, and the presence of a secondary (satellite) drop is considered highly undesirable. FIGS. 7, 8, and 9 graphically illustrate the effects of variation of acoustic power.

Variation of Acoustic Frequency

Figure 10:
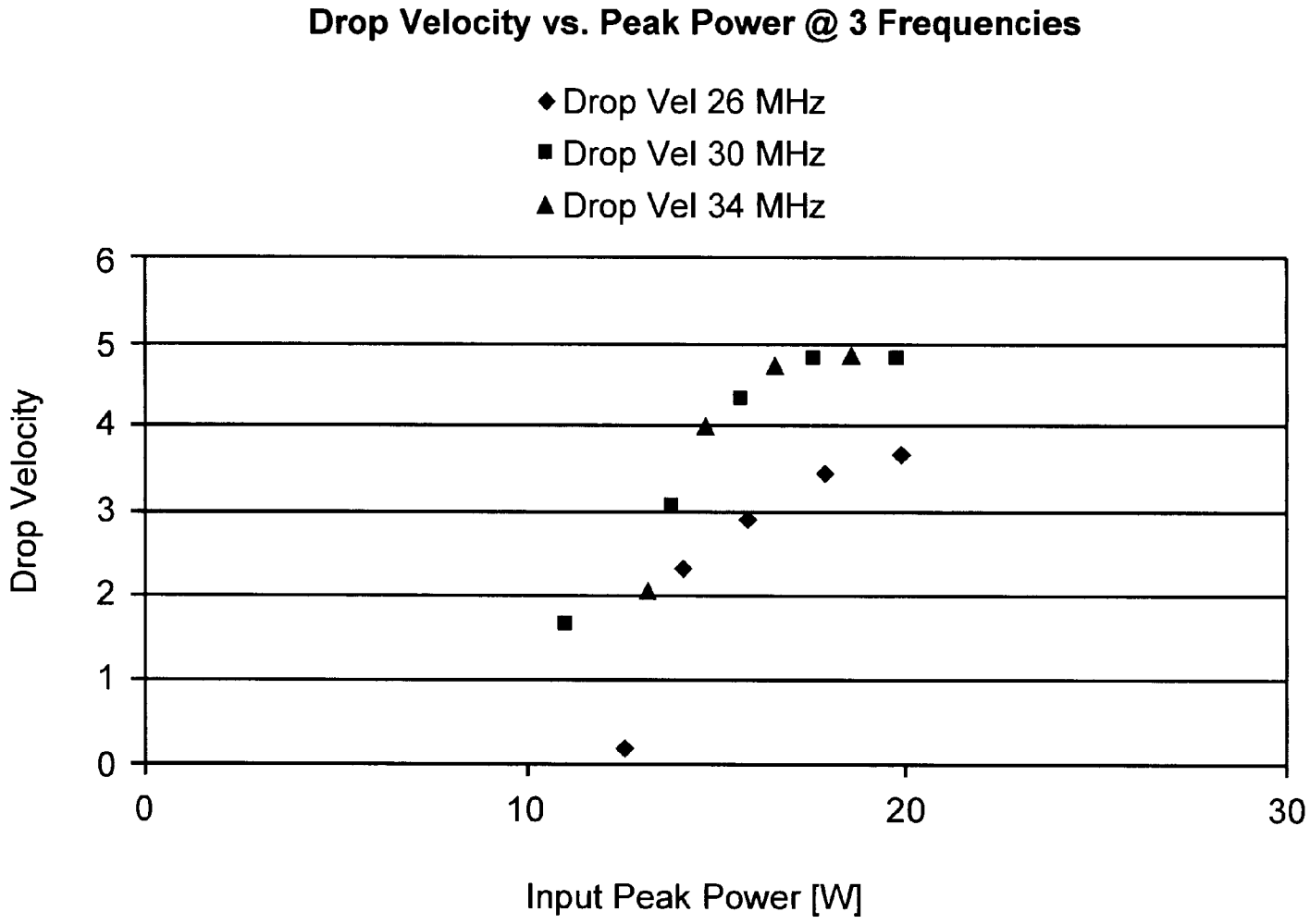
FIG. 10 graphically illustrates changes in droplet velocity with respect to acoustic frequency at various input power levels using a 26, 30, and 34 MHz acoustic frequencies.

As discussed above, variation of the acoustic frequency enables significant variation in the range of ejected fluid volume when the applied acoustic power is sufficient to eject both primary and secondary drops. Variation of the acoustic frequency alone when only primary droplets are ejected has only a limited effect on droplet volume but does increase droplet velocity. FIGS. 9 and 10 illustrate the variation in both droplet velocity and droplet size at 26, 30, and 34 MHz, using varying input power.

Variation of Toneburst Duration

As discussed above, variation of the acoustic duration significantly enables variation in the range of ejected fluid volume when the applied acoustic power is sufficient to eject both primary and secondary drops. Variation of the toneburst duration when only primary droplets are ejected is capable of varying droplet diameter by about 40%, corresponding to a change in droplet volume of as much as 300%. Alternatively, variation of toneburst duration may be used to vary droplet velocity by over 100%. FIGS. 4, 5, 6, and 7 graphically illustrate the effects of variation of toneburst duration.

It is, of course, understood that optimal variations of the above-discussed parameters will depend upon the specific fluids and lens selected and such modifications are well within the abilities of one of skill in the art.

Illustrated Embodiments

FIG. 2 illustrates an embodiment of the inventive device in simplified cross-sectional view. As with all figures referenced herein, in which like parts are referenced by like numerals, FIG. 2 is not to scale, and certain dimensions may be exaggerated for clarity of presentation. The device 31 includes a plurality of reservoirs, i.e., at least two reservoirs, with a first reservoir indicated at 33 and a second reservoir indicated at 35, each adapted to contain a fluid having a fluid surface, e.g., a first fluid 34 and a second fluid 36 having fluid surfaces respectively indicated at 37 and 39. Fluids 34 and 36 may the same or different. As shown, the reservoirs are of substantially identical construction so as to be substantially acoustically indistinguishable, but identical construction is not a requirement. The reservoirs are shown as separate removable components but may, if desired, be fixed within a plate or other substrate. For example, the plurality of reservoirs may comprise individual wells in a well plate, optimally although not necessarily arranged in an array. Each of the reservoirs 33 and 35 is preferably axially symmetric as shown, having vertical walls 41 and 43 extending upward from circular reservoir bases 45 and 47 and terminating at openings 49 and 31, respectively, although other reservoir shapes may be used. The material and thickness of each reservoir base should be such that acoustic radiation may be transmitted therethrough and into the fluid contained within the reservoirs.

The device also includes an acoustic ejector 53 comprised of an acoustic radiation generator 55 for generating acoustic radiation and a focusing means 57 for focusing the acoustic radiation at a focal point within the fluid from which a droplet is to be ejected, near the fluid surface. As shown in FIG. 3, the focusing means 57 may comprise a single solid piece having a concave surface 59 for focusing acoustic radiation, but the focusing means may be constructed in other ways as discussed below. The acoustic ejector 53 is thus adapted to generate and focus acoustic radiation so as to eject a droplet of fluid from each of the fluid surfaces 37 and 39 when acoustically coupled to reservoirs 33 and 35 and thus to fluids 34 and 36, respectively. The acoustic radiation generator 55 and the focusing means 57 may function as a single unit controlled by a single controller, or they may be independently controlled, depending on the desired performance of the device. Typically, single ejector designs are preferred over multiple ejector designs because accuracy of droplet placement and consistency in droplet size and velocity are more easily achieved with a single ejector.

As will be appreciated by those skilled in the art, any of a variety of focusing means may be employed in conjunction with the present invention so long as the lens has an F-number of greater than approximately 2. For example, one or more curved surfaces may be used to direct acoustic radiation to a focal point near a fluid surface. One such technique is described in U.S. Pat. No. 4,308,547 to Lovelady et al. Focusing means with a curved surface have been incorporated into the construction of commercially available acoustic transducers such as those manufactured by Panametrics Inc. (Waltham, Mass.). In addition, Fresnel lenses are known in the art for directing acoustic energy at a predetermined focal distance from an object plane. See, e.g., U.S. Pat. No. 5,041,849 to Quate et al. Fresnel lenses may have a radial phase profile that diffracts a substantial portion of acoustic energy into a predetermined diffraction order at diffraction angles that vary radially with respect to the lens. The diffraction angles should be selected to focus the acoustic energy within the diffraction order on a desired object plane.

There are also a number of ways to acoustically couple the ejector 53 to each individual reservoir and thus to the fluid therein. One such approach is through direct contact as is described, for example, in U.S. Pat. No. 4,308,547 to Lovelady et al., wherein a focusing means constructed from a hemispherical crystal having segmented electrodes is submerged in a liquid to be ejected. The aforementioned patent further discloses that the focusing means may be positioned at or below the surface of the liquid. However, this approach for acoustically coupling the focusing means to a fluid is undesirable when the ejector is used to eject different fluids in a plurality of containers or reservoirs, as repeated cleaning of the focusing means would be required in order to avoid cross-contamination. The cleaning process would necessarily lengthen the transition time between each droplet ejection event. In addition, in such a method, fluid would adhere to the ejector as it is removed from each container, wasting material that may be costly or rare.

Thus, a preferred approach would be to acoustically couple the ejector to the reservoirs and reservoir fluids without contacting any portion of the ejector, e.g., the focusing means, with any of the fluids to be ejected. To this end, the present invention provides an optional ejector positioning means for positioning the ejector in controlled and repeatable acoustic coupling with each of the fluids in the reservoirs to eject droplets therefrom without submerging the ejector therein. This typically involves direct or indirect contact between the ejector and the external surface of each reservoir. When direct contact is used in order to acoustically couple the ejector to each reservoir, it is preferred that the direct contact is wholly conformal to ensure efficient acoustic energy transfer. That is, the ejector and the reservoir should have corresponding surfaces adapted for mating contact. Thus, if acoustic coupling is achieved between the ejector and reservoir through the focusing means, it is desirable for the reservoir to have an outside surface that corresponds to the surface profile of the focusing means. Without conformal contact, efficiency and accuracy of acoustic energy transfer may be compromised. In addition, since many focusing means have a curved surface, the direct contact approach may necessitate the use of reservoirs having a specially formed inverse surface.

Figure 2A:
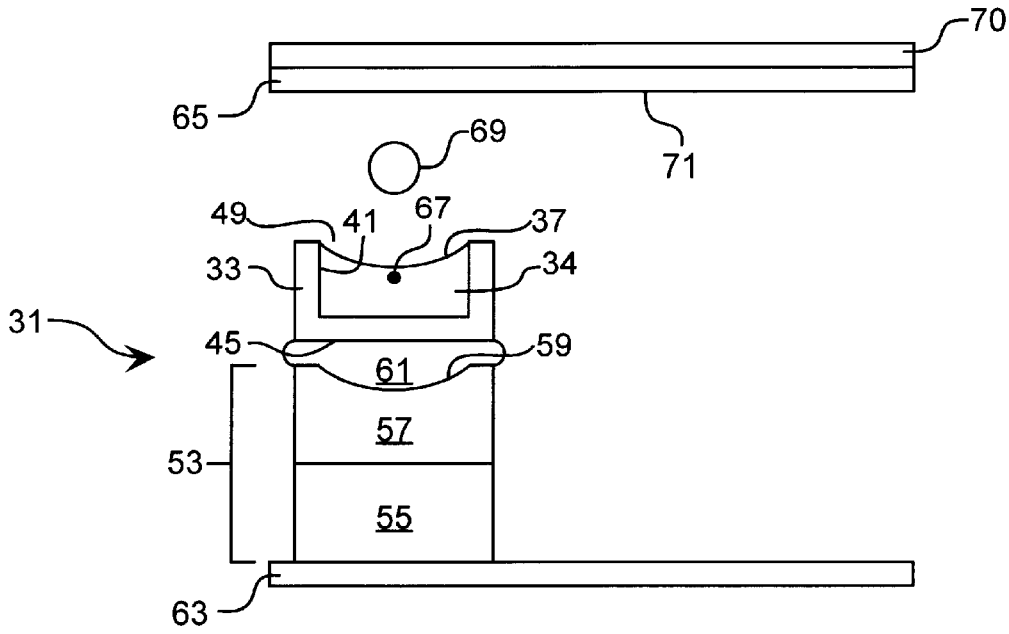
FIGS. 2A and 2B, collectively referred to as FIG. 2, schematically illustrate in simplified cross-sectional view an embodiment of the inventive device comprising first and second reservoirs, an acoustic ejector, and an ejector positioning means.

Optimally, acoustic coupling is achieved between the ejector and each of the reservoirs through indirect contact, as illustrated in FIG. 2A. In the figure, an acoustic coupling medium 61 is placed between the ejector 63 and the base 45 of reservoir 33, with the ejector and reservoir located at a predetermined distance from each other. The acoustic coupling medium may be an acoustic coupling fluid, preferably an acoustically homogeneous material in conformal contact with both the acoustic focusing means 67 and each reservoir. In addition, it is important to ensure that the fluid medium is substantially free of material having different acoustic properties than the fluid medium itself. As shown, the first reservoir 33 is acoustically coupled to the acoustic focusing means 67 such that the acoustic radiation generator generates an acoustic wave, which is in turn directed by the focusing means 67 into the acoustic coupling medium 61, which then transmits the acoustic radiation into the reservoir 33.

In operation, reservoirs 33 and 35 of the device are each filled with first and second fluids 34 and 36, respectively, as shown in FIG. 2. The acoustic ejector 53 is positionable by means of ejector positioning means 63, shown below reservoir 33, in order to achieve acoustic coupling between the ejector and the reservoir through acoustic coupling medium 61. Substrate 65 is positioned above and in proximity to the first reservoir 33 such that one surface of the substrate, shown in FIG. 2 as underside surface 71, faces the reservoir and is substantially parallel to the surface 37 of the fluid 44 therein. Once the ejector, the reservoir and the substrate are in proper alignment, the acoustic radiation generator 55 is activated to produce acoustic radiation that is directed by the focusing means 57 to a focal point 67 near the fluid surface 37 of the first reservoir. As a result, droplet 69 is ejected from the fluid surface 37 onto a designated site on the underside surface 71 of the substrate. The ejected droplet may be retained on the substrate surface by solidifying thereon after contact; in such an embodiment, it is necessary to maintain the substrate at a low temperature, i.e., a temperature that results in droplet solidification after contact. Alternatively, or in addition, a molecular moiety within the droplet attaches to the substrate surface after contract, through adsorption, physical immobilization, or covalent binding.

Figure 2B:
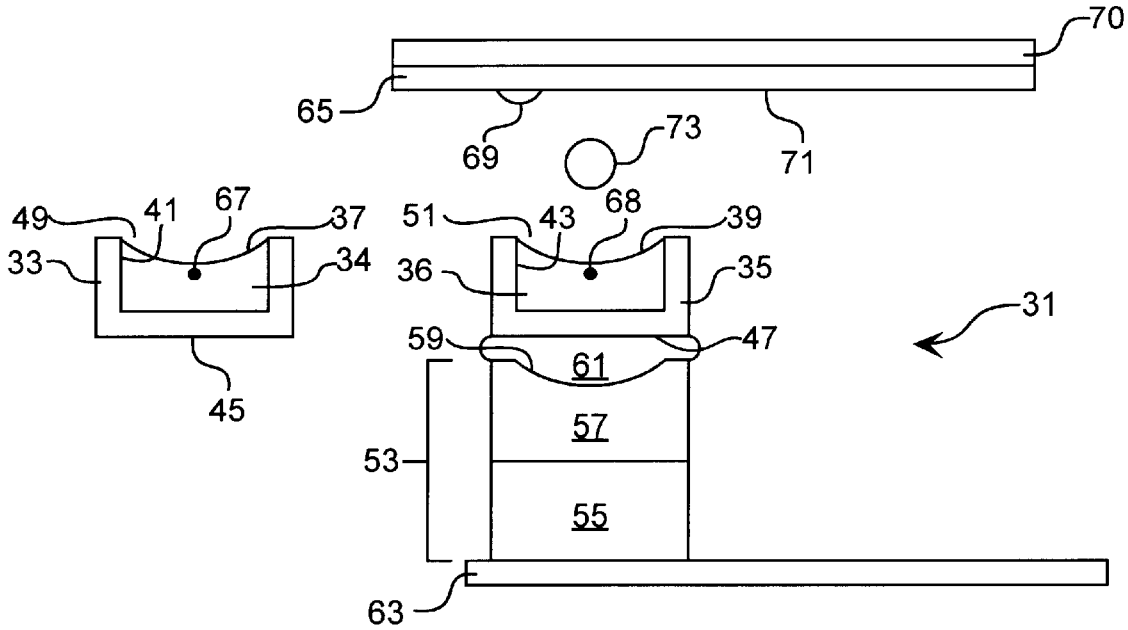

Then, as shown in FIG. 2B, a substrate positioning means 70 repositions the substrate 65 over reservoir 35 in order to receive a droplet therefrom at a second designated site. FIG. 2B also shows that the ejector 53 has been repositioned by the ejector positioning means 63 below reservoir 35 and in acoustically coupled relationship thereto by virtue of acoustic coupling medium 61. Once properly aligned as shown in FIG. 2B, the acoustic radiation generator 55 of ejector 53 is activated to produce acoustic radiation that is then directed by focusing means 57 to a focal point within fluid 36 near the fluid surface 39, thereby ejecting droplet 73 onto the substrate. It should be evident that such operation is illustrative of how the inventive device may be used to eject a plurality of fluids from reservoirs in order to form a pattern, e.g., an array, on the substrate surface 71. It should be similarly evident that the device may be adapted to eject a plurality of droplets from one or more reservoirs onto the same site of the substrate surface.

Figure 3A:
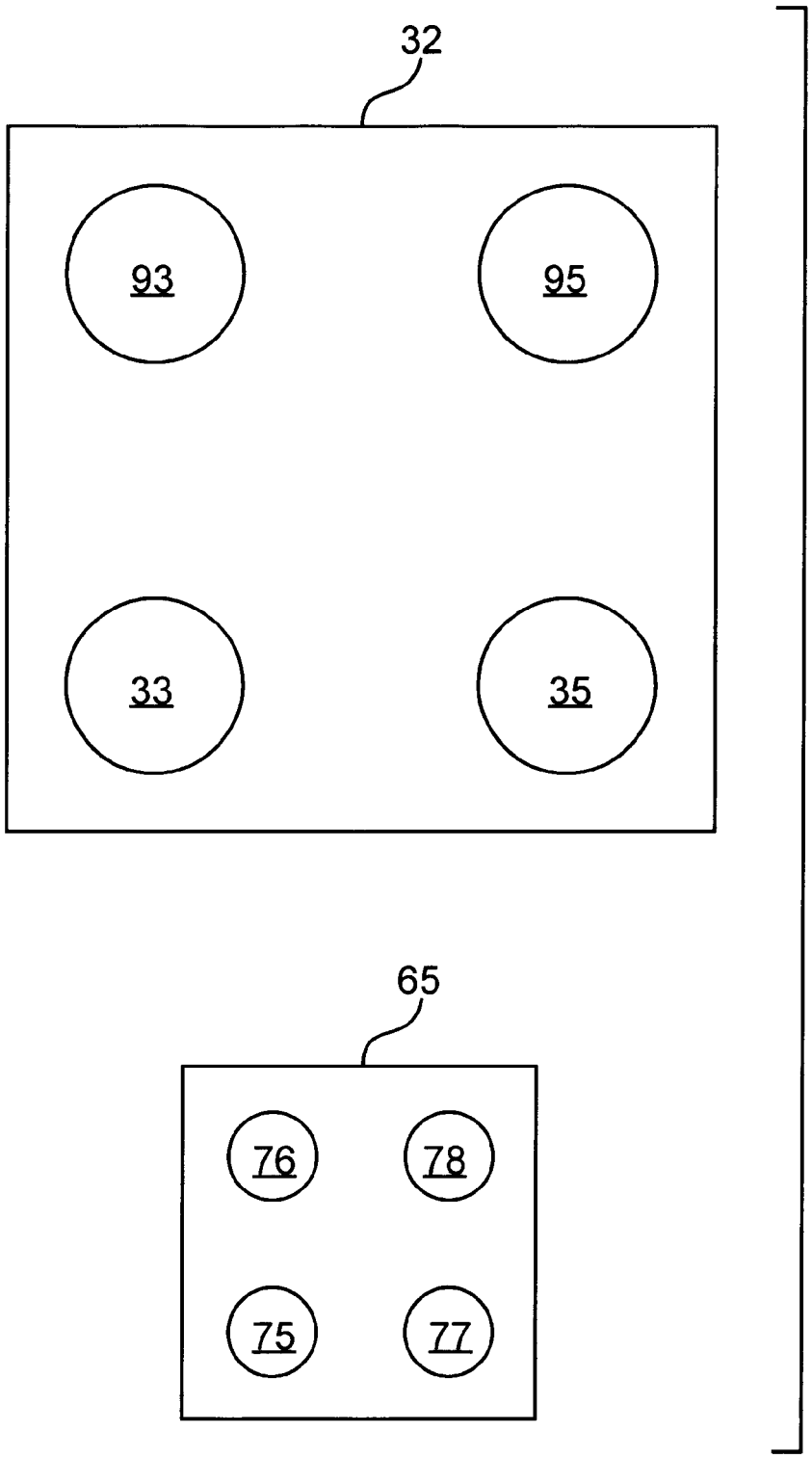
FIGS. 3A, 3B and 3C, collectively referred to as FIG. 3, illustrate in schematic view a variation of the inventive embodiment of FIG. 2 wherein the reservoirs comprise individual wells in a reservoir well plate and the substrate comprises a smaller well plate with a corresponding number of wells.
Figure 3B:
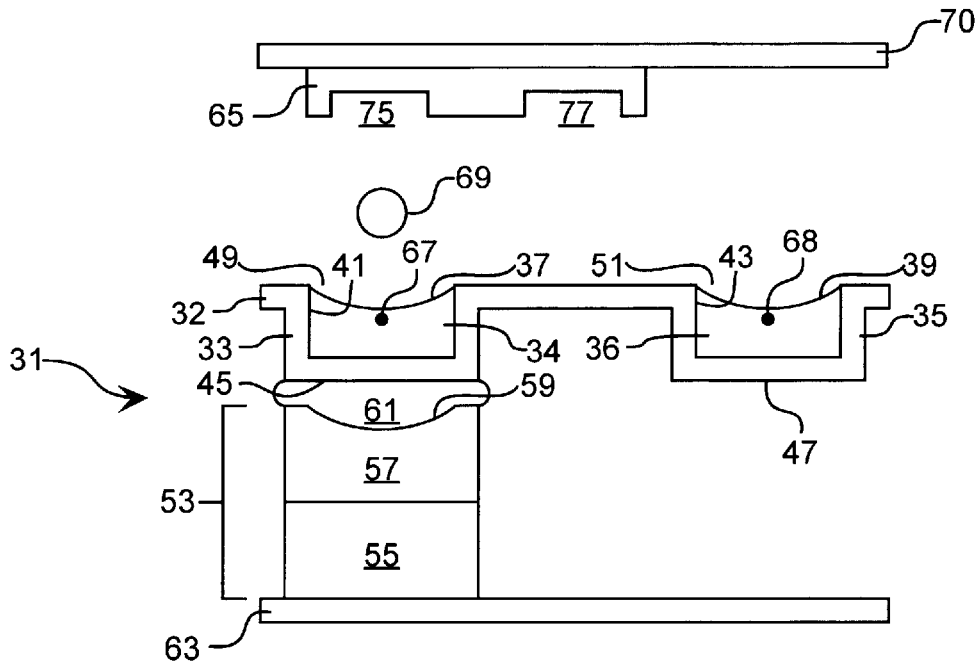

In another embodiment, the device is constructed so as to allow transfer of fluids between well plates, in which case the substrate comprises a substrate well plate, and the fluid-containing reservoirs are individual wells in a reservoir well plate. FIG. 3 illustrates such a device, wherein four individual wells 33, 35, 93 and 95 in reservoir well plate 32 serve as fluid reservoirs for containing a fluid to be ejected, and the substrate comprises a smaller well plate 65 of four individual wells indicated at 75, 76, 77 and 78. Although the substrate plate is depicted as a smaller well plate than the reservoir well plate, this is not to be considered a limitation, as transfer may take place between well plates of any two sizes. FIG. 3A illustrates the reservoir well plate and the substrate well plate in top plan view. As shown, each of the well plates contains four wells arranged in a two-by-two array. FIG. 3B illustrates the inventive device wherein the reservoir well plate and the substrate well plate are shown in cross-sectional view along wells 33, 35 and 75, 77, respectively. As in FIG. 2, reservoir wells 33 and 35 respectively contain fluids 34 and 36 having fluid surfaces respectively indicated at 37 and 39. The materials and design of the wells of the reservoir well plate are similar to those of the reservoirs illustrated in FIG. 2. For example, the reservoir wells shown in FIG. 3B are of substantially identical construction so as to be substantially acoustically indistinguishable. In this embodiment as well, the bases of the reservoirs are of a material and thickness so as to allow efficient transmission of acoustic radiation therethrough into the fluid contained within the reservoirs.

The device of FIG. 3 also includes an acoustic ejector 53 having a construction similar to that of the ejector illustrated in FIG. 2, i.e., the ejector is comprised of an acoustic generating means 55 and a focusing means 57. FIG. 3B shows the ejector acoustically coupled to a reservoir well through indirect contact; that is, an acoustic coupling medium 61 is placed between the ejector 63 and the reservoir well plate 32, i.e., between the curved surface 59 of the acoustic focusing means 57 and the base 45 of the first reservoir well 33. As shown, the first reservoir well 33 is acoustically coupled to the acoustic focusing means 67 such that acoustic radiation generated in a generally upward direction is directed by the focusing mean 67 into the acoustic coupling medium 61, which then transmits the acoustic radiation into the reservoir well 33.

In operation, each of the reservoir wells is preferably filled with a different fluid. As shown, reservoir wells 33 and 35 of the device are each filled with a first fluid 34 and a second fluid 36, as in FIG. 2, to form fluid surfaces 37 and 39, respectively. FIG. 3A shows that the ejector 63 is positioned below reservoir well 33 by an ejector positioning means 63 in order to achieve acoustic coupling therewith through acoustic coupling medium 61. The first substrate well 75 of substrate well plate 65 is positioned above the first reservoir well 33 in order to receive a droplet ejected from the first reservoir well. Once the ejector, the reservoir and the substrate are in proper alignment, the acoustic radiation generator is activated to produce an acoustic wave that is focused by the focusing means to direct the acoustic wave to a focal point 67 near fluid surface 37. As a result, droplet 69 is ejected from fluid surface 37 into the first substrate well 75 of the substrate well plate 65. The droplet is retained in the substrate well plate by solidifying thereon after contact, by virtue of the low temperature at which the substrate well plate is maintained. That is, the substrate well plate is preferably associated with a cooling means (not shown) to maintain the substrate surface at a temperature that results in droplet solidification after contact.

Figure 3C:
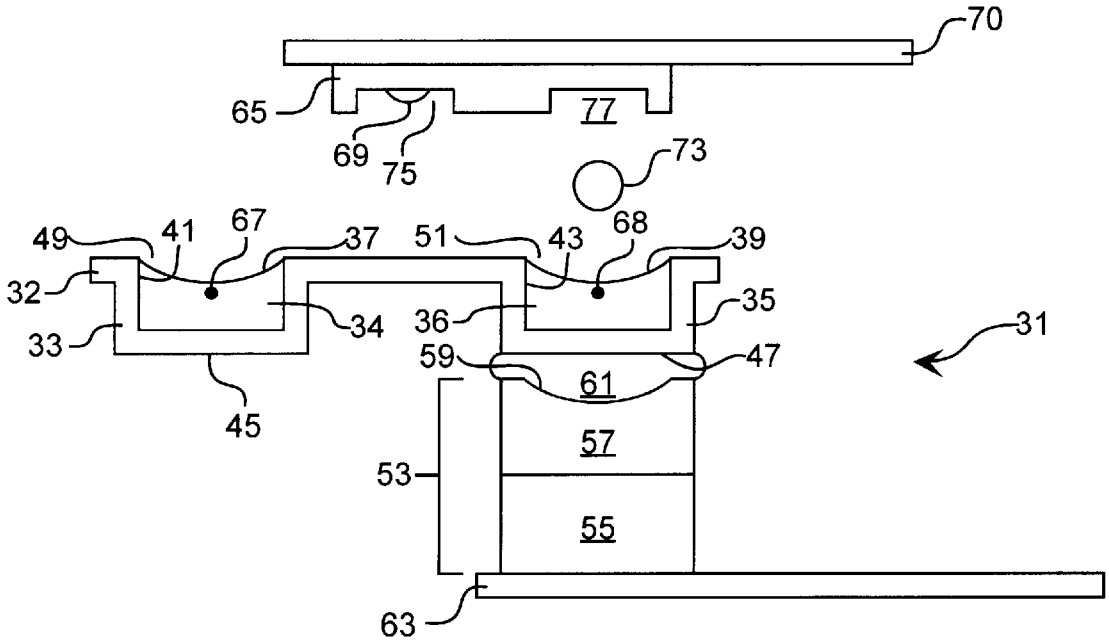
Figure 4:
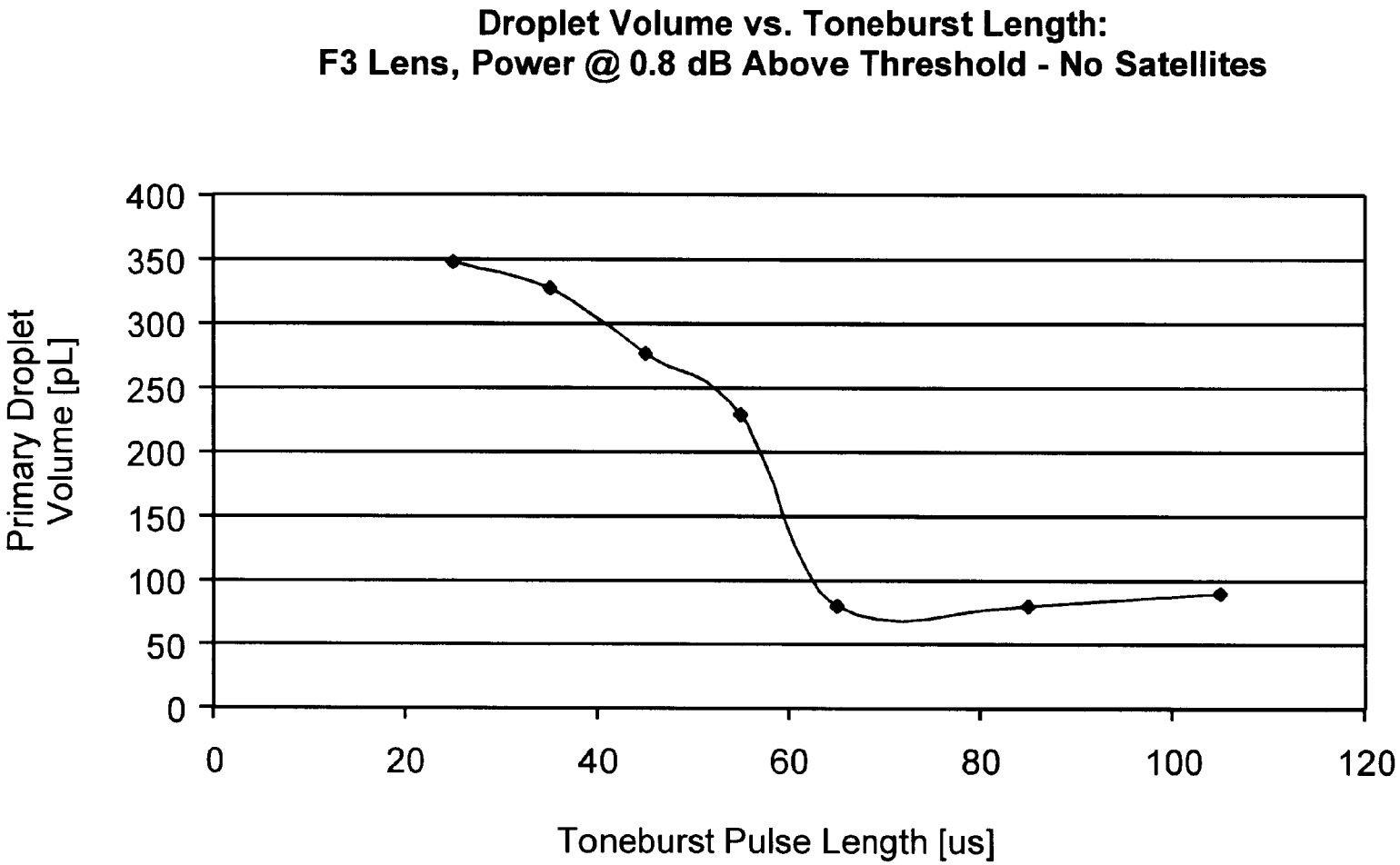
FIG. 4 graphically illustrates changes in droplet volume with respect to toneburst duration for an F3 lens using acoustic power 0.8 dB above the ejection threshold and having an acoustic frequency of 26 MHz.
Figure 5:
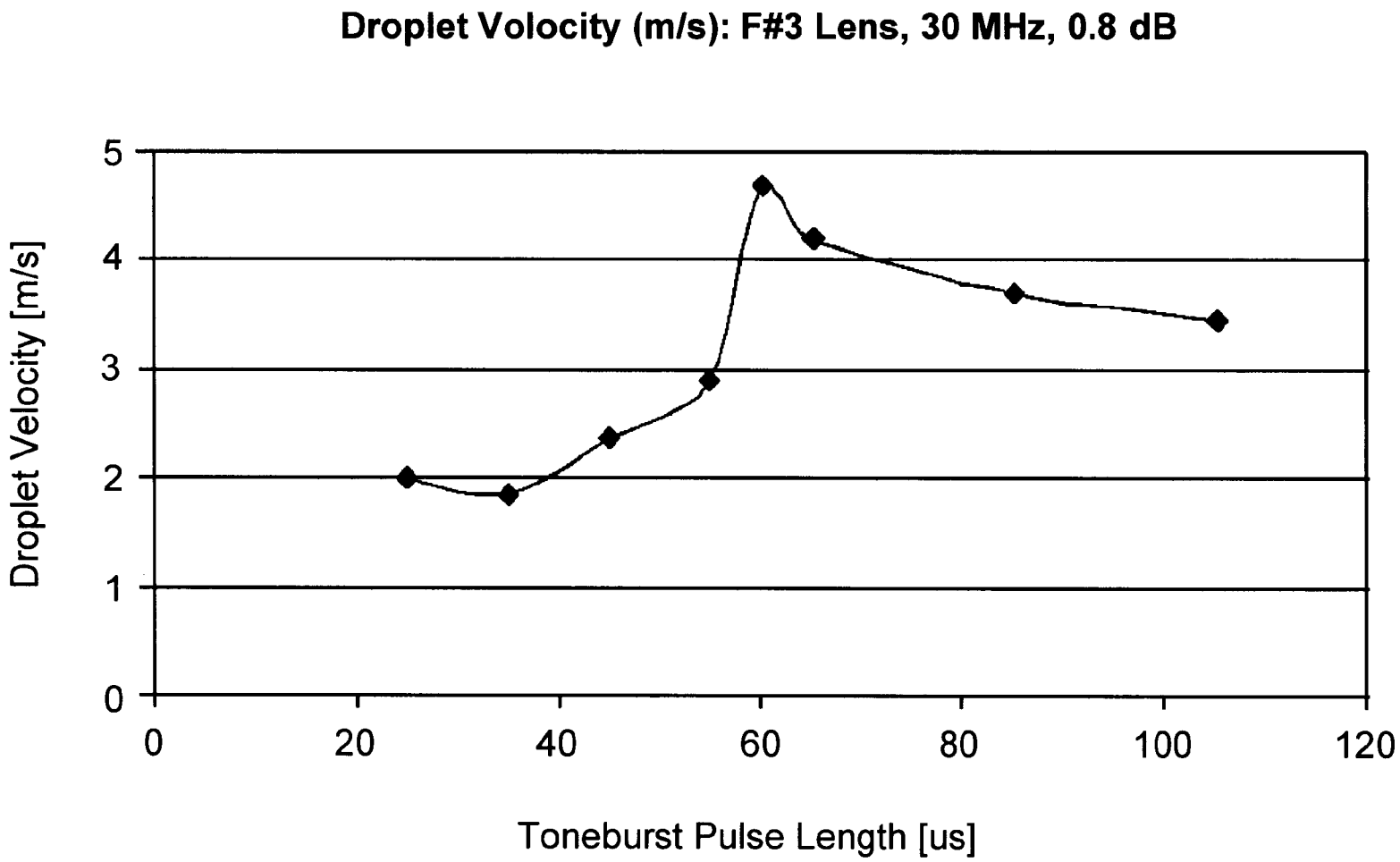
FIG. 5 graphically illustrates changes in droplet velocity with respect to toneburst duration for an F3 lens using acoustic power 0.8 dB above the ejection threshold and having an acoustic frequency of 30 MHz.
Figure 6:
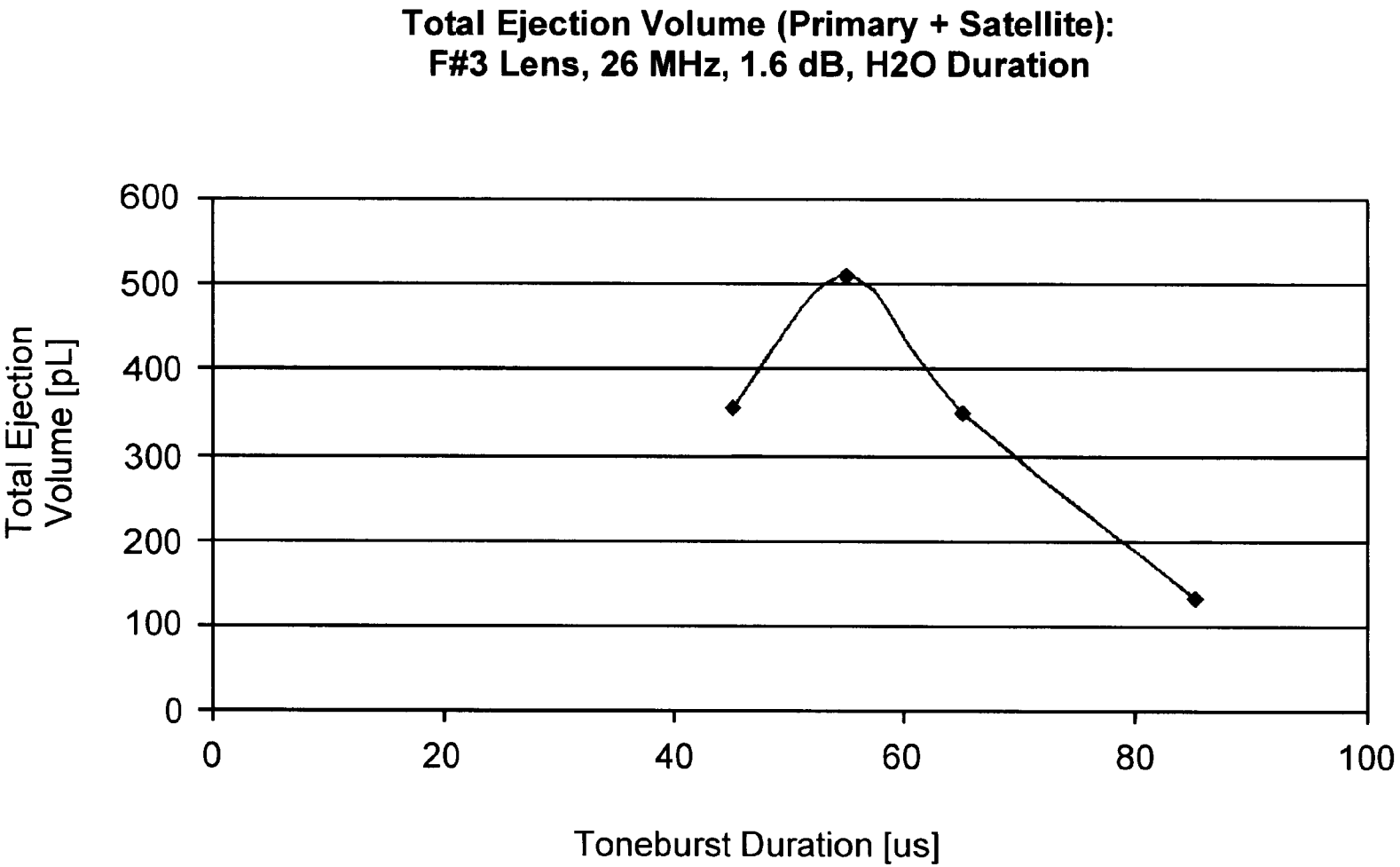
FIG. 6 graphically illustrates changes in total ejection volume with respect to toneburst duration for an F3 lens using acoustic power 1.6 dB above the ejection threshold and having an acoustic frequency of 26 MHz.

Then, as shown in FIG. 3C, the substrate well plate 65 is repositioned by a substrate positioning means 70 such that substrate well 77 is located directly over reservoir well 35 in order to receive a droplet therefrom. FIG. 3C also shows that the ejector 53 has been repositioned below reservoir well 35 by the ejector positioning means so as to acoustically couple the ejector and the reservoir through acoustic coupling medium 61. Since the substrate well plate and the reservoir well plate are differently sized, there is only correspondence, not identity, between the movement of the ejector positioning means and the movement of the substrate well plate. Once properly aligned as shown in FIG. 3C, the acoustic radiation generator 55 of ejector 53 is activated to produce an acoustic wave that is then directed by focusing means 57 to a focal point near the fluid surface 39 from which droplet 73 is ejected onto the second well of the substrate well plate. It should be evident that such operation is illustrative of how the inventive device may be used to transfer a plurality of fluids from one well plate to another of a different size. One of ordinary skill in the art will recognize that this type of transfer may be carried out even when both the ejector and substrate are in continuous motion. It should be further evident that a variety of combinations of reservoirs, well plates and/or substrates may be used in using the inventive device to engage in fluid transfer. It should be still further evident that any reservoir may be filled with a fluid through acoustic ejection prior to deploying the reservoir for further fluid transfer, e.g., for array deposition.

As discussed above, either individual, e.g., removable, reservoirs or well plates may be used to contain fluids that are to be ejected, wherein the reservoirs or the wells of the well plate are preferably substantially acoustically indistinguishable from one another. Also, unless it is intended that the ejector is to be submerged in the fluid to be ejected, the reservoirs or well plates must have acoustic transmission properties sufficient to allow acoustic radiation from the ejector to be conveyed to the surfaces of the fluids to be ejected. Typically, this involves providing reservoir or well bases that are sufficiently thin to allow acoustic radiation to travel therethrough without unacceptable dissipation. In addition, the material used in the construction of reservoirs must be compatible with the fluids contained therein. Thus, if it is intended that the reservoirs or wells contain an organic solvent such as acetonitrile, polymers that dissolve or swell in acetonitrile would be unsuitable for use in forming the reservoirs or well plates. For water-based fluids, a number of materials are suitable for the construction of reservoirs and include, but are not limited to, ceramics such as silicon oxide and aluminum oxide, metals such as stainless steel and platinum, and polymers such as polyester and polytetrafluoroethylene.

Many well plates suitable for use with the inventive device are commercially available and may contain, for example, 96, 384 or 1536 wells per well plate. Manufactures of suitable well plates for use in the inventive device include Coming Inc. (Corning, N.Y.) and Greiner America, Inc. (Lake Mary, Fla.). However, the availability of such commercially available well plates does not preclude manufacture and use of custom-made well plates containing at least about 10,000 wells, or as many as 100,000 wells or more. For array forming applications, it is expected that about 100,000 to about 4,000,000 reservoirs may be employed. In addition, to reduce the amount of movement needed to align the ejector with each reservoir or reservoir well, it is preferable that the center of each reservoir is located not more than about 1 centimeter, preferably not more than about 1 millimeter and optimally not more than about 0.5 millimeter from any other reservoir center.

Moreover, the device may be adapted to eject fluids of virtually any type and amount desired. The fluid may be aqueous and/nor nonaqueous. Nonaqueous fluids include, for example, water, organic solvents, and lipidic liquids, and, because the invention is readily adapted for use with high temperatures, fluids such as liquid metals, ceramic materials, and glasses may be used; see, e.g., co-pending patent application U.S. Ser. No. 09/669,194 ("Method and Apparatus for Generating Droplets of Immiscible Fluids"), inventors Ellson, and Mutz, and Foote filed Sep. 25, 2000, and assigned to Picoliter, Inc. (Mountain View, Calif.). The capability of producing fine droplets of such materials is in sharp contrast to piezoelectric technology, insofar as piezoelectric systems perform suboptimally at elevated temperatures. Furthermore, because of the precision that is possible using the inventive technology, the device may be used to eject droplets from a reservoir adapted to contain no more than about 100 nanoliters of fluid, preferably no more than 10 nanoliters of fluid. In certain cases, the ejector may be adapted to eject a droplet from a reservoir adapted to contain about 1 to about 100 nanoliters of fluid. This is particularly useful when the fluid to be ejected contains rare or expensive biomolecules, wherein it may be desirable to eject droplets having a volume of about up to 1 picoliter. The ability of large F-numbered lenses to eject drops from reservoirs wherein the ratio of the distance to the surface of the fluid is much greater than the aperture contained within the base of the reservoir, i.e., 3 to 5 times greater, allows for the ejection of droplets adapted to contain anywhere from 0.01 picoliters to 20 picoliters.

From the above, it is evident that various components of the device may require individual control or synchronization to form an array on a substrate. For example, the ejector positioning means may be adapted to eject droplets from each reservoir in a predetermined sequence associated with an array to be prepared on a substrate surface. Similarly, the substrate positioning means for positioning the substrate surface with respect to the ejector may be adapted to position the substrate surface to receive droplets in a pattern or array thereon. Either or both positioning means, i.e., the ejector positioning means and the substrate positioning means, may be constructed from, e.g., levers, pulleys, gears, a combination thereof, or other mechanical means known to one of ordinary skill in the art. It is preferable to ensure that there is a correspondence between the movement of the substrate, the movement of the ejector, and the activation of the ejector to ensure proper pattern formation.

Moreover, the device may include other components that enhance performance. For example, as alluded to above, the device may further comprise cooling means for lowering the temperature of the substrate surface to ensure, for example, that the ejected droplets adhere to the substrate. The cooling means may be adapted to maintain the substrate surface at a temperature that allows fluid to partially or preferably substantially solidify after the fluid comes into contact therewith. In the case of aqueous fluids, the cooling means should have the capacity to maintain the substrate surface at about 0° C. In addition, repeated application of acoustic energy to a reservoir of fluid may result in heating of the fluid. Heating can of course result in unwanted changes in fluid properties such as viscosity, surface tension and density. Thus, the device may further comprise means for maintaining fluid in the reservoirs at a constant temperature. Design and construction of such temperature maintaining means are known to one of ordinary skill in the art and may comprise, e.g., components such as a heating element, a cooling element, or a combination thereof. For many biomolecular deposition applications, it is generally desired that the fluid containing the biomolecule is kept at a constant temperature without deviating more than about 1° C. or 2° C. therefrom. In addition, for a biomolecular fluid that is particularly heat sensitive, it is preferred that the fluid be kept at a temperature that does not exceed about 10° C. above the melting point of the fluid, preferably at a temperature that does not exceed about 5° C. above the melting point of the fluid. Thus, for example, when the biomolecule-containing fluid is aqueous, it may be optimal to keep the fluid at about 4° C. during ejection.

The device of the invention enables ejection of droplets at a rate of at least about 1,000,000 droplets per minute from the same reservoir, and at a rate of at least about 100,000 drops per minute from different reservoirs. In addition, current positioning technology allows for the ejector positioning means to move from one reservoir to another quickly and in a controlled manner, thereby allowing fast and controlled ejection of different fluids. That is, current commercially available technology allows the ejector to be moved from one reservoir to another, with repeatable and controlled acoustic coupling at each reservoir, in less than about 0.1 second for high performance positioning means and in less than about 1 second for ordinary positioning means. A custom designed system will allow the ejector to be moved from one reservoir to another with repeatable and controlled acoustic coupling in less than about 0.001 second. In order to provide a custom designed system, it is important to keep in mind that there are two basic kinds of motion: pulse and continuous. Pulse motion involves the discrete steps of moving an ejector into position, emitting acoustic energy, and moving the ejector to the next position; again, using a high performance positioning means with such a method allows repeatable and controlled acoustic coupling at each reservoir in less than 0.1 second. A continuous motion design, on the other hand, moves the ejector and the reservoirs continuously, although not at the same speed, and provides for ejection during movement. Since the pulse width is very short, this type of process enables over 10 Hz reservoir transitions, and even over 1000 Hz reservoir transitions.

It is to be understood that while the invention has been described in conjunction with the preferred specific embodiments thereof, the foregoing description is intended to illustrate and not limit the scope of the invention. Other aspects, advantages and modifications will be apparent to those skilled in the art to which the invention pertains. All patents, patent applications, journal articles and other references cited herein are incorporated by reference in their entireties.

We claim:

1. A device for acoustically ejecting a fluid droplet toward a designated site on a substrate surface, comprising:

(a) a reservoir adapted to contain a fluid and having an aperture that enables conduction of acoustic energy in a substantially uniform manner, said aperture having a selected cross-sectional width; and (b) an ejector comprised of an acoustic radiation generator for generating acoustic radiation and a focusing means capable of focusing the generated acoustic radiation to emit a droplet from a surface of a fluid contained within the fluid reservoir said surface being an effective distance from the aperture, wherein the ratio of the effective distance to the cross-sectional width of the aperture is greater than about 2:1.

2. The device of claim 1, further comprising:

(c) a means for positioning the ejector (i) in acoustic coupling relationship to the reservoir.

3. The device of claim 2, comprising a plurality of reservoirs each adapted to contain a fluid, and wherein the device is capable of ejecting a fluid droplet from each of the plurality of reservoirs toward a plurality of designated sites on the substrate surface.

4. The device of claim 3, wherein each of the reservoirs is removable from the device.

5. The device of claim 3, wherein each reservoir comprises an individual well in a well plate.

6. The device of claim 5, wherein the well plate contains at least 96 wells.

7. The device of claim 5, wherein the well plate contains at least 384 wells.

8. The device of claim 5, wherein the well plate contains at least 1536 wells.

9. The device of claim 5, wherein the well plate contains at least 3456 wells.

10. The device of claim 3, wherein the reservoirs are arranged in an array.

11. The device of claim 3, wherein the reservoirs are substantially acoustically indistinguishable.

12. The device of claim 3, wherein at least one of the reservoirs is adapted to contain no more than about 100 nanoliters of fluid.

13. The device of claim 12, wherein at least one of the reservoirs is adapted to contain no more than about 10 nanoliters of fluid.

14. The device of claim 3, wherein at least one reservoir contains a fluid.

15. The device of claim 14, wherein each reservoir contains a different fluid.

16. The device of claim 14, wherein at least one of the reservoirs contains an aqueous fluid.

17. The device of claim 14, wherein at least one of the reservoirs contains a nonaqueous fluid.

18. The device of claim 14, wherein at least one of the reservoirs contains two substantially immiscible fluids.

19. The device of claim 18, wherein the nonaqueous fluid comprises an organic solvent.

20. The device of claim 19 wherein the organic solvent is selected from the group consisting of halogenated hydrocarbons, alcohols, aldehydes, amides, amines, carboxylic acids, esters, ethers, halogenated hydrocarbons, hydrocarbons, lactams, nitriles, organic nitrates, organic sulfides, and mixtures thereof.

21. The device of claim 14, wherein at least one of the fluid containing reservoirs contains a biomolecule.

22. The device of claim 21, wherein the biomolecule is selected from the group consisting of nucleotides, peptides, oligomers, and polymers.

23. The device of claim 21, wherein the biomolecule is attached to a cell.

24. The device of claim 3, wherein the positioning means is adapted to repeatedly reposition the ejector so to enable ejection of a droplet from each of the reservoirs.

25. The device of claim 24, further comprising a substrate positioning means for positioning the substrate surface with respect to the ejector.

26. The device of claim 3, further comprising a means for maintaining a fluid in each reservoir at a constant temperature.

27. The device of claim 3, comprising a single ejector.

28. The device of claim 2, wherein the acoustic coupling relationship comprises positioning the ejector such that the acoustic radiation is generated and focused external to the reservoir.

29. The device of claim 28, wherein the acoustic coupling relationship between the ejector and the fluid in the reservoir is established by providing an acoustically conductive medium between the ejector and the reservoir.

30. The device of claim 1, wherein said ratio is greater than approximately 3:1.

31. The device of claim 1, wherein said ratio is greater than approximately 4:1.

32. The device of claim 1, wherein the designated site on the substrate surface comprises an individual well in a well plate.

33. The device of claim 1, comprising at least about 10,000 reservoirs.

34. The device of claim 33, comprising at least about 100,000 reservoirs.

35. The device of claim 34, comprising in the range of about 100,000 to about 4,000,000 reservoirs.

36. The device of claim 1, further comprising cooling means for lowering the temperature of the substrate surface.

37. The device of claim 36, wherein the cooling means is adapted to maintain the substrate surface at a temperature that causes deposited fluid to substantially solidify after contact with the substrate surface.

38. A method for ejecting a fluid from a fluid reservoir toward designated sites on a substrate surface, comprising:

(a) providing a device comprised of:

(i) a reservoir containing a first fluid, said reservoir having an aperture that enables conduction of acoustic energy in a substantially uniform manner, said aperture having a selected cross-sectional width; and (ii) an ejector comprised of an acoustic radiation generator for generating acoustic radiation and a focusing means capable of focusing the generated acoustic radiation to emit a droplet from a surface of the first fluid contained within the fluid reservoir said surface being an effective distance from the aperture, wherein the ratio of the effective distance from the focusing means to the cross-sectional width of the aperture is greater than about 2:1.;

(b) positioning the ejector so as to be in acoustically coupled relationship to the fluid-containing reservoir, wherein the position of the ejector places the focusing means the effective distance away from the surface of the first fluid; and (c) activating the ejector to generate acoustic radiation having a focal spot of a diameter D at the surface of the first fluid, thereby ejecting a droplet of the first fluid from the reservoir.

39. The method of claim 38, wherein said ratio is greater than approximately 3:1.

40. The method of claim 38, wherein said ratio is greater than approximately 4:1.

41. The method of claim 38, wherein the ejected droplet has a diameter less than the diameter of the focal spot.

42. The method of claim 41, wherein two droplets are ejected during step (c).

43. The method of claim 42, wherein the two ejected droplets are deposited as first and second droplets and the second droplet is larger than the first droplet.

44. The method of claim 42, wherein each of the ejected droplets has a width less than D.

45. The method of claim 38, wherein the device comprises a plurality of reservoirs each adapted to contain a fluid, and wherein the device is capable of ejecting a fluid droplet from each of the plurality of reservoirs toward a plurality of designated sites on the substrate surface and the method further comprises:

(d) positioning the ejector so as to be in acoustically coupled relationship to a second fluid-containing reservoir containing a second fluid; and (e) activating the ejector as in step (b) to eject a droplet of the second fluid from the second reservoir toward a second designated site on the substrate surface.

46. The method of claim 45, wherein each of the ejected droplets of the first fluid and second fluids has a width less than D.

47. The method of claim 45, wherein two droplets are ejected during at least one of steps (c) or (e).

48. The method of claim 47, wherein each of the two droplets ejected during step (c) or (e) has a width less than D.

49. The method of claim 47, wherein at least two ejected droplets are deposited at the same designated site on the substrate surface.

50. The method of claim 49, wherein the two ejected droplets are deposited as first and second droplets and the second droplet is larger than the first droplet.

51. The method of claim 45, wherein prior to step (c) an acoustic radiation tone burst duration is selected that is sufficient to achieve a desired droplet size and during step (c) the ejector is activated so as to generate a tone burst of acoustic radiation of the selected duration, thereby ejecting a droplet of the desired size.

52. The method of claim 45, wherein prior to step (c) an acoustic radiation tone burst duration is selected that is sufficient to achieve a desired droplet velocity and during step (c) the ejector is activated so as to generate a tone burst of acoustic radiation of the selected duration, thereby ejecting a droplet at the desired droplet velocity.

53. The method of claim 45, further comprising repeating steps (d) and (e) with one or more additional fluid-containing reservoirs.

54. The method of claim 45, wherein each of the ejected droplets has a volume of about up to 1 picoliter.

55. The method of claim 45, further comprising, before each ejector activation step, measuring the fluid level in the reservoir in acoustically coupled relationship with the ejector.

56. The method of claim 55, wherein each measuring step is carried out acoustically.

57. The method of claim 56, wherein each measuring step is carried out using acoustic radiation from the ejector.

58. The method of claim 38, wherein prior to step (c) an acoustic radiation tone burst duration is selected that is sufficient to achieve a desired droplet size and during step (c) the ejector is activated so as to generate a tone burst of acoustic radiation of the selected duration, thereby ejecting a droplet of the desired size.

59. The method of claim 38, wherein prior to step (c) an acoustic radiation tone burst duration is selected that is sufficient to achieve a desired droplet velocity and during step (c) the ejector is activated so as to generate a tone burst of acoustic radiation of the selected duration, thereby ejecting a droplet at the desired droplet velocity.

* * * * *